US009205663B2

(12) United States Patent
Paschkewitz

(10) Patent No.: US 9,205,663 B2
(45) Date of Patent: Dec. 8, 2015

(54) INKJET PRINT HEADS WITH INDUCTIVE HEATING

(71) Applicant: Palo Alto Research Center Incorporated, Palo Alto, CA (US)

(72) Inventor: John S. Paschkewitz, San Carlos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 14/225,957

(22) Filed: Mar. 26, 2014

(65) Prior Publication Data

US 2015/0273849 A1 Oct. 1, 2015

(51) Int. Cl.
*B41J 2/14* (2006.01)
*B41J 2/175* (2006.01)

(52) U.S. Cl.
CPC ..... *B41J 2/17593* (2013.01)

(58) Field of Classification Search
USPC ..... 347/20, 53
See application file for complete search history.

(56) References Cited

U.S. PATENT DOCUMENTS

| | | | | |
|---|---|---|---|---|
| 3,535,481 | A | 10/1970 | Korb | |
| 5,479,684 | A | 1/1996 | Murphy | |
| 7,902,639 | B2 * | 3/2011 | Garrou et al. | 257/622 |
| 8,092,000 | B2 | 1/2012 | Alavizadeh et al. | |
| 8,770,732 | B2 * | 7/2014 | Jones et al. | 347/88 |
| 2013/0021404 | A1 | 1/2013 | Kuznetsov et al. | |

FOREIGN PATENT DOCUMENTS

| | | | | |
|---|---|---|---|---|
| EP | 1803567 | | 7/2007 | |
| JP | 08072241 | * | 3/1996 | B41J 2/05 |

* cited by examiner

*Primary Examiner* — Anh T. N. Vo
(74) *Attorney, Agent, or Firm* — Hollingsworth Davis, LLC

(57) ABSTRACT

Embodiments are directed to a polymeric print head useful for inkjet printing. The inkjet print head has an injection molded, polymeric ink-carrying portion that includes conductive particles. The print head also includes a plurality of inductor coils embedded in a inductive heating portion. The plurality of inductor coils are configured to generate a magnetic field that induces heat in the conductive particles. The print head includes a source of high frequency, low amperage alternating current that is configured to supply current to at least one of the plurality of inductor coils.

20 Claims, 9 Drawing Sheets

INKJET PRINT HEADS WITH INDUCTIVE HEATING

TECHNICAL FIELD

The present disclosure relates generally to methods and devices useful for inkjet print heads, including integrated inductive heating elements and methods of manufacturing of the same.

BACKGROUND

Inkjet print heads are manufactured using stacked metal plates or stacks of metal and plastic layers. In the case of solid inkjet print heads, the print heads are kept close to a phase change temperature of a solid ink using, for example, adhesively mounted resistance heaters. Injection molding of polymers using overmolding can be used to make inkjet print heads that include integrated resistance heaters at lower cost and with higher part-to-part uniformity than using stacks of metal or metal and plastic plates. However, injection molded inkjet print heads can present thermal challenges since plastic has low thermal conductivity.

SUMMARY

Embodiments described herein are directed to methods and assemblies used in ink jet printing. Some embodiments are directed to an assembly for an ink jet print head that includes an ink flow path configured to allow passage of a phase-change ink. One or more inductive heating elements may be configured to heat the ink. Relatively uniform heating throughout the volume of a molded part, such as an inkjet print head, can be achieved by using inductive heating elements. In one aspect, a molded plastic part, such as an inkjet print head, is disclosed that includes a polymeric ink-carrying portion. The ink-carrying portion is capable of inductive heating response. The inductive heating response may be the result of including conductive particles in the ink-carrying portion. Additionally, the print head includes a plurality of inductor coils molded into a polymeric inductive heating portion. The print head further includes a source of alternating current configured to supply current to at least one of the plurality of inductor coils.

A method is disclosed that includes energizing at least one of a plurality of inductor coils arranged in an ink jet print head, the energizing causing inductive heating of an ink-carrying portion of the print head. The method further includes flowing ink through the ink-carrying portion, wherein the inductive heating of the ink-carrying portion maintains a temperature of the ink above a melting temperature.

Finally, a method of making a print head is disclosed that includes forming an ink-carrying portion of a print head that is responsive to inductive heating. The method further includes arranging a plurality of inductor coils in proximity to the ink-carrying portion so that the inductor coils, when energized, induce heat in the ink-carrying portion.

The above summary is not intended to describe each disclosed embodiment or every implementation of the present disclosure. A more complete understanding will become apparent and appreciated by referring to the following detailed description and claims in conjunction with the accompanying drawings.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1:
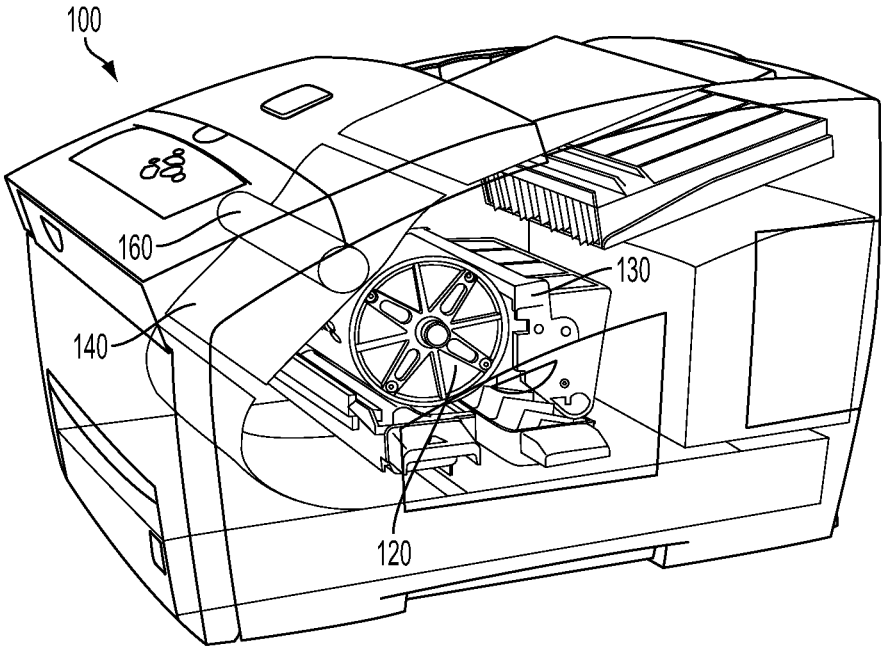
FIGS. 1 and 2 provide internal views of portions of an ink jet printer that incorporates an injection molded print head and inductive heating features.

In the following description, reference is made to the accompanying set of drawings that form a part of the description hereof and in which are shown by way of illustration of several specific embodiments. It is to be understood that other embodiments are contemplated and may be made without departing from the scope of the present invention. The following detailed description, therefore, is not to be taken in a limiting sense.

Ink jet printers operate by ejecting small droplets of liquid ink onto print media according to a predetermined pattern. In some implementations, the ink is ejected directly on a final print media, such as paper. In some implementations, the ink is ejected on an intermediate print media, e.g. a print drum, and is then transferred from the intermediate print media to the final print media. Some ink jet printers use cartridges of liquid ink to supply the ink jets. Solid ink printers have the capability of using phase-change ink that is solid at room temperature and is melted before being jetted onto the print media surface. Inks that are solid at room temperature advantageously allow the ink to be transported and loaded into the ink jet printer in solid form, without the packaging or cartridges typically used for liquid inks. In some implementations, the solid ink is melted in a page-width print head which jets the molten ink in a page-width pattern onto an intermediate drum. The pattern on the intermediate drum is transferred onto paper through a pressure nip.

The term phase-change (or solid) inkjet printing refers to image-forming processes and/or image-forming devices that employ inks that are presented in a solid, often wax-like, form. The solid inks can be melted into a liquid form or phase between an ink loading portion of an ink storage (reservoir) and supply device and an ejection-type ink delivery print head. The ejection-type ink delivery print head may dispense the ink presented to it in a melted/liquid form or phase onto a heated intermediate transfer structure such as an intermediate transfer drum, or directly onto a substrate of an image receiving medium, which may also have been preliminarily heated to better accept the melted ink.

Phase-change inkjet printers can melt the solid ink to a liquid at an outlet end of the ink storage and supply device before the ink is fed to the complex plumbing of an inkjet print head. The ink then, in its heated/liquid form or phase, can be jetted from the nozzles using a piezoelectric actuated print head, sometimes referred to as a "jetstack." The print head can be used to deliver the ink, in its heated/liquid form or phase, to a heated surface of the intermediate transfer apparatus for further transfer to a substrate of image receiving medium, or directly to the substrate where the ink cools to form a sometimes significantly raised printed image on the substrate.

Embodiments described herein are directed to an inkjet print head that includes an inductive ink heater arranged to heat ink in the print head. The inductive ink heater comprises an ink carrying portion and a inductive heating portion proximate to the ink carrying portion. The ink carrying portion includes materials capable of an electromagnetic inductive heating response. The materials in the ink-carrying portion that are responsive to the electromagnetic induction are inductively heated by one or more inductive heating elements, e.g., inductor coils, embedded in the inductive heating portion. The inductive heating response in the ink-carrying portion may be configured to heat the ink by a specified temperature uniformity in the ink-carrying portion. Uniform heating within a specified tolerance across and/or through the ink-carrying portion of the inkjet print head may be achieved by controlling the inductive heating. The print head may further include a source alternating current (AC) coupled to supply current to at least one of the plurality of inductive heating elements.

Figure 2:
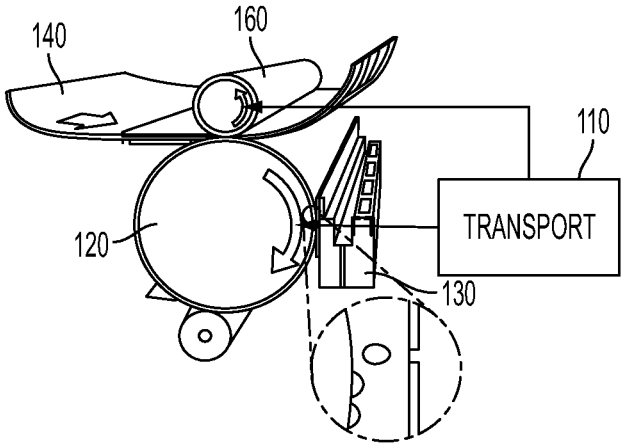

FIGS. 1 and 2 provide internal views of portions of an ink jet printer 100 that incorporates a print head having an inductive ink heater in accordance with embodiments disclosed. The printer 100 includes a transport mechanism 110 that is configured to move the drum 120 relative to the print head 130 and to move the paper 140 relative to the drum 120. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
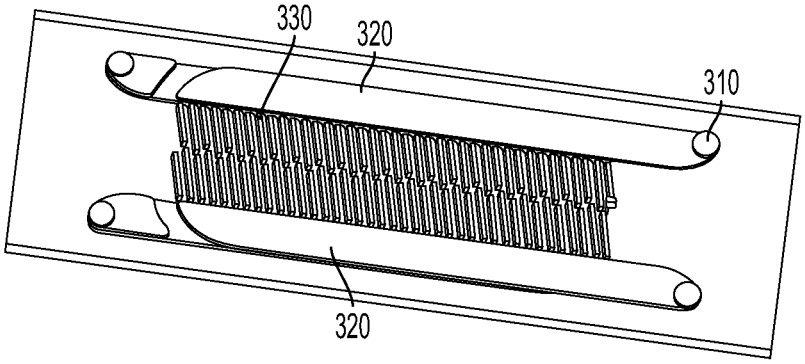
FIGS. 3 and 4 show views of an exemplary print head with inductive heating features.
Figure 4:
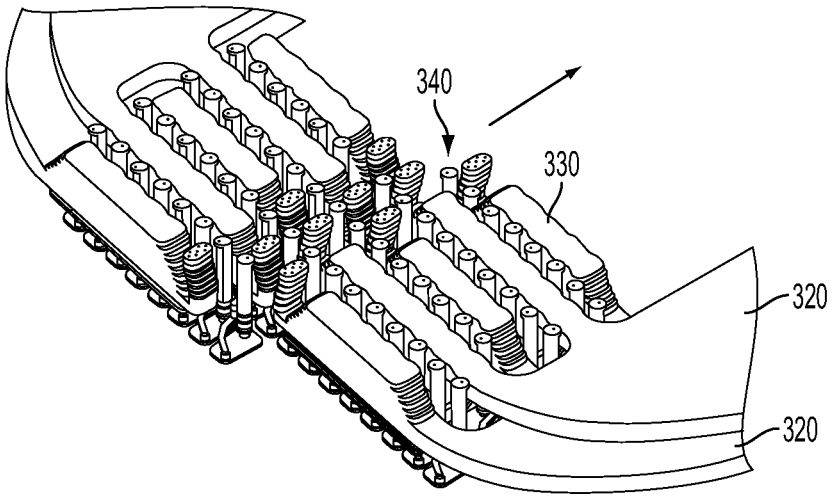

FIGS. 3 and 4 show more detailed views of an exemplary print head with inductive heating features in accordance with embodiments disclosed herein. The path of molten ink, contained initially in a reservoir, flows through a port 310 into a main manifold 320 of the print head. As best seen in FIG. 4, in some cases, there are four main manifolds 320 which are overlaid, one manifold 320 per ink color (for example, yellow, cyan, magenta, and black), and each of these manifolds 320 connects to interwoven finger manifolds 330. The ink passes through the finger manifolds 330 and then into the ink jets 340. The manifold and ink jet geometry illustrated in FIG. 4 is repeated to achieve a desired print head length, e.g. the full width of the drum.

The inkjet print head may include one or more ink pressure chambers coupled to, or in fluid communication with, one or more ink inlets, via which ink is introduced into the inkjet print head from one or more ink sources, and one or more ink ejection outlets, for example, apertures, orifices or nozzles, via which ink is ejected as a stream of ink droplets to be deposited on a substrate. A typical inkjet printer includes a plurality of print heads with a plurality of ink pressure chambers with each of the plurality of ink pressure chambers being in fluid communication with one or more of the apertures/orifices. Each aperture/orifice may be in fluid communication with a respective ink pressure chamber by way of the ink passage.

Figure 5:
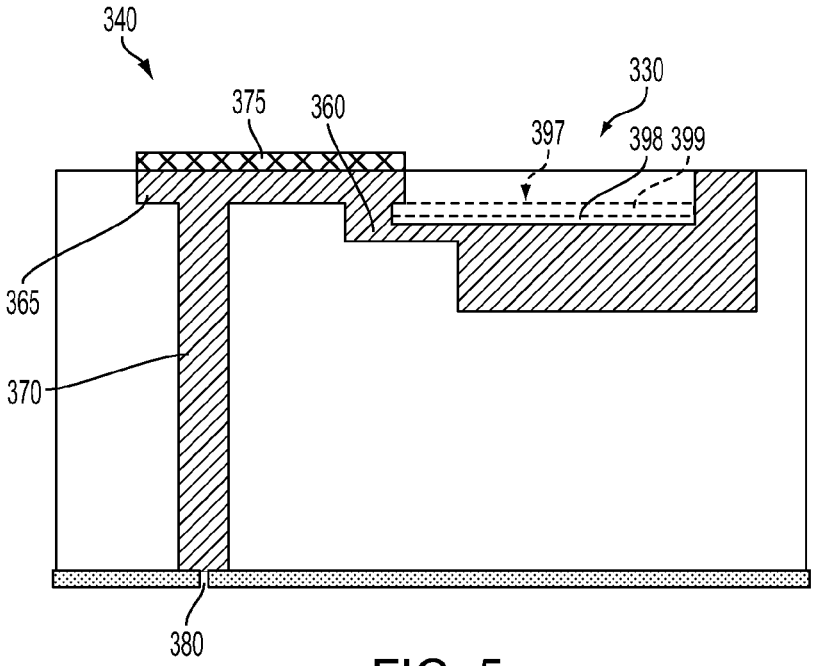
FIG. 5 provides a view of a finger manifold and ink jet that shows a possible location for inductive heating features.

FIG. 5 provides a view of a finger manifold 330 and ink jet 340 that shows a possible location for the inductive heater 397 including the ink carrying portion 398 and the inductive heating portion 399. In this figure, the inductive heating features 398, 399 are located at the finger manifold and are arranged to heat the ink within the finger manifold portion of the print head. The inductive heating features 398, 399 may be located in a variety of other locations, such as proximate the reservoir, ink jets, ports or other locations, for example, and arranged to heat the ink in these locations. The print head may include multiple inductive heating features positioned at one or more locations within the print head.

In some examples, the print head uses piezoelectric transducers (PZTs) for ink droplet ejection, although other methods of ink droplet ejection. Activation of the PZT 375 causes a pumping action that alternatively draws ink into the ink jet body 365 and expels the ink through ink jet outlet 370 and aperture 380. In this example, as the ink moves through the finger manifold 340, the inductive heating features 398, 399 heat the ink and to maintain the ink carrying portion 398 at a specified temperature and/or specified temperature uniformity as the ink passes through the finger manifold 330.

Figure 6A:
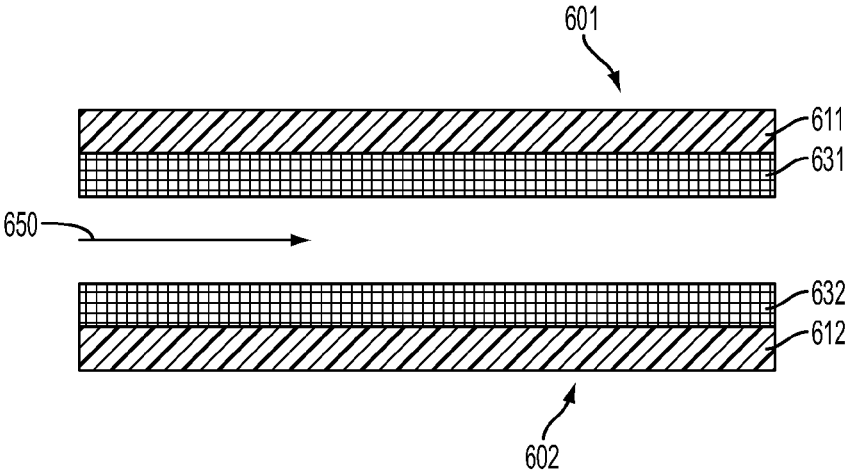
FIG. 6A shows an ink flow path through ink carrying portions including inductive heating portions.

FIG. 6A shows an ink flow path 650 through channel walls 601, 602 wherein each of the channel walls 601, 602 include an inductive heating feature comprising an ink-carrying portion 631, 632 and an inductive heating portion 611, 612. Although FIG. 6A shows inductive heating features disposed in the channel walls on both sides of the ink flow path, it will be appreciated that inductive features may be disposed in only one channel wall in some embodiments. The ink carrying portions 631, 632 are each adjacent to and on opposite sides of the ink flow path 650. As shown in the illustrated embodiment, the ink carrying portion 631, 632 is disposed between the ink flow path 650 and the inductive heating portion 611, 612. Some embodiments include multiple ink carrying portions that are each inductively responsive to the inductive heating elements included in a single inductive heating portion. Some embodiments include multiple inductive heating portions arranged to inductively energize a single ink carrying portion. In some embodiments that use two or more inductive heating features (as illustrated in FIG. 6A), the inductive heating portions 611, 612 and/or ink-carrying portion 631, 632 may be placed directly across from each other in relation to the ink flow path 650. Alternatively, the inductive heating portions and/or ink-carrying portion may be staggered along the ink flow path. In some embodiments the inductive heating portions and/or ink carrying portions may be adjacent one another on the same side of the ink flow path.

In some embodiments, each inductive heating portion is configured so that the magnetic field generated by the inductive heating portion is stronger at an ink-carrying portion nearest to the inductive heating portion when compared to a channel wall disposed at an opposite side of the ink flow path. The channel wall disposed at the opposing side may also include an ink-carrying portion capable of inductive response. For example, with reference to FIG. 6A, when energized, inductive heating portion 611 produces a magnetic field having a field strength that is greater at channel wall 601 and ink carrying portion 631 compared to the field strength produced by inductive heating portion 612 at channel wall 602 and ink carrying portion 632. Thus, an inductive heating portion arranged on one side of the ink flow path asymmetrically heats the ink in the ink flow path by heating an ink carrying portion proximate to the inductive heating portion without heating (or while heating less) an ink carrying portion on an opposing side of the ink flow path.

When heating portions of the injection molded inkjet print head, it can be difficult to control the heat flux introduced to and permeating the solid wax ink in a jetstack. In the solid ink heating/melting process, the ability to heat the ink to a specified temperature within a specified time accelerates the heating process in a controlled manner. Furthermore, uniform heating of the inkjet print head to within a specified tolerance helps provide consistent inkjet drop size and consistent velocity when the ink is jetted from the print head.

Some embodiments use an inductive heating portion comprising a plurality of small inductor coils co-molded into the inductive heating portion of the print head to achieve more precise heating. Example embodiments include inkjet print heads that have an injection-molded, polymeric induction heating features including the ink-carrying portion capable of an inductive response and a plurality of inductor coils molded into an inductive heating portion of the print head. The inductor coils are configured to generate a magnetic field when energized by an alternating current (AC) and induce heat in the ink-carrying portion. The ink-carrying portion comprises conductive particles and/or filler material that is capable of an inductive response. In some implementations, particles and/or filler may be semiconductive, however, both conductive and semiconductive particles/filler are collectively referred to herein using the term "conductive" with the understanding that the particles and/or filler may be conductive, semiconductive, or a combination of conductive and semiconductive. The inductor coils are configured to be connected to a source that supplies AC to at least one of the plurality of inductor coils. In some embodiments, there may be multiple sources of AC, e.g., each of the inductor coils may be configured to be respectively coupled to one of the AC sources or groups of the inductor coils may be configured to be coupled to one of the AC sources. When energized, the inductor coils produce a magnetic field that can interact with the conductive particles and/or filler within the flux lines of the magnetic field, the magnetic field producing eddy currents in the particles/filler that induce heat in the particles and/or filler. As referred to herein induction responsive particles comprise discrete conductive particles or regions disposed in a binder (which may or may not be inductively responsive), e.g., a polymeric binder. An inductively responsive filler material comprises a homogeneous portion of inductively responsive material.

Figures 6B, 6C:
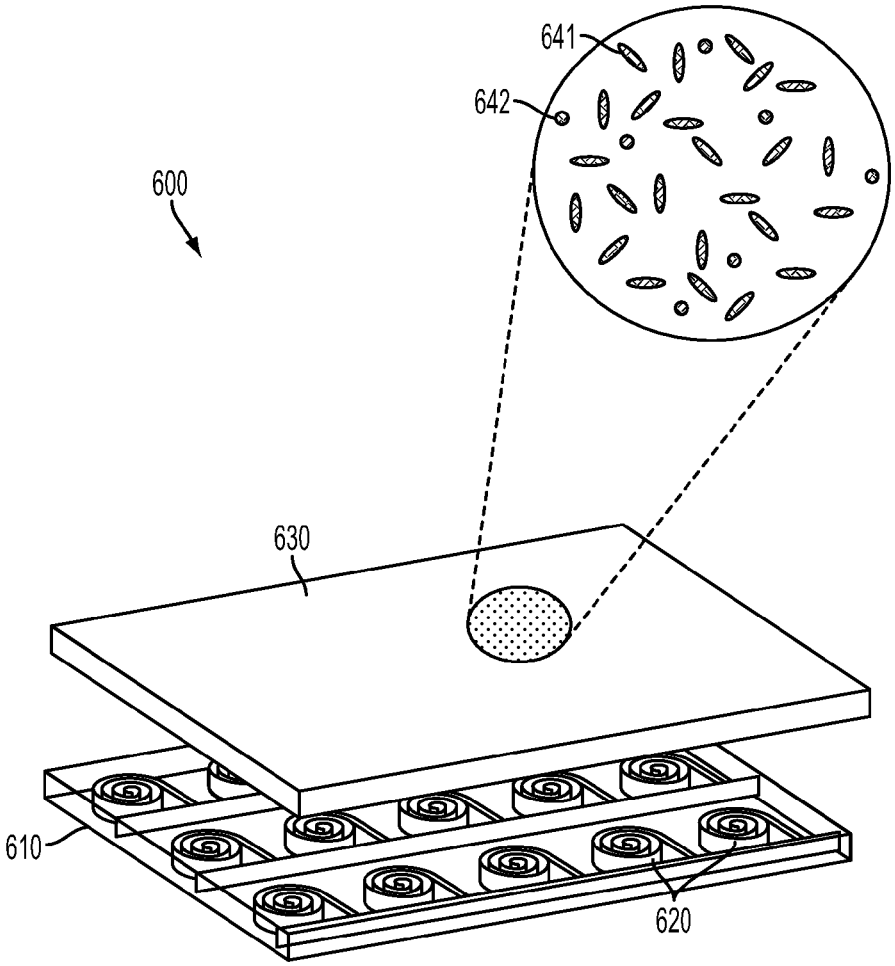
FIG. 6B is a perspective view of an example embodiment of a disclosed print head.
FIG. 6C is an exploded view of a portion of the print head illustrated in FIG. 6B.

FIG. 6B is a perspective view of a portion of an embodiment of an inkjet print head inductive heater wherein the view is exploded to show the ink carrying portion and the inductive heating portion of an inductive print head heater. Inductive heater 600 includes an injection molded, polymeric ink-carrying portion 630 and an injection molded inductive heating portion. Only a back wall of polymeric ink-carrying portion 630 is shown in FIG. 6B for illustrative purposes. The polymeric ink-carrying portion 630 can be arranged within or as a channel wall defining an ink flow path within the inkjet print head.

FIG. 6B also shows an inductive heating portion 610 configured to be arranged proximate to the ink carrying portion 630. The inductive heating portion 610 comprises a plurality of inductor coils 620 embedded within. In some embodiments, the inductor coils 620 may be molded into inductive heating portion 610 during an injection molding or other molding process. The inductor coils 620 may comprise a conductive polymer or a metallic material. In some embodiments, the inductor coils 620 may comprise a liquid metal that is molded into the inductive heating portion 610.

In FIG. 6B the inductor coils 620 are shown as small, flat spiral coils. The size of the coils is related to the degree of spatial resolution achievable in the temperature gradient across the ink carrying portion. If many small coils are used, the spatial resolution of the temperature uniformity increases. In some embodiments the spiral coils may be very small and uniformly distributed throughout the inductive heating portion. In some embodiments, the diameter of the inductor coils may be less than about 5 mm in diameter, less than about 2 mm in diameter, less than about 1 mm in diameter, or even less than 0.5 mm in diameter. In various embodiments the inductor coils may be serpentine coils or may have any other appropriate shape that provides for inductive heating of the ink carrying portion. In each row, the coils may be electrically connected in series or may be electrically connected in parallel as shown in FIG. 6B with all coils in the row coupled to a common bus bar. The distance between individual coils may be selected to provide spatially uniform heating within the specified tolerance.

When energized, the inductor coils are configured to generate a magnetic field that induces eddy currents that subsequently heat the conductive particles. At least one of the plurality of inductor coils can be energized by a source of high frequency, low amperage alternating current, e.g., 20 MHz, 0.5 A and 20 kV, supplied by a source not illustrated in FIG. 6B. A high frequency magnetic field may achieve more uniform excitation of conductive elements, such as metal or carbon, placed throughout the body of a polymeric portion of the inkjet print head. The use of a low current, high voltage and a high frequency current above 1 MHz can prevent heat generating in the inductor coils and the need for active cooling with, for example, a liquid coolant. Use of lower frequency excitation of the conductive particles may also cause dielectric breakdown or a highly non-uniform thermal response.

FIG. 6C is an exploded view of a portion of the print head and shows a plurality of conductive particles and/or filler 641, 642 within the illustrated view of the polymeric ink-carrying portion 630. The particles and/or filler are also sometimes called conductive "susceptor" materials. The conductive particles and/or filler can be made of any materials that have a high thermal and good electrical conductivity and that are configured to respond to an applied magnetic field so as to generate eddy currents and inductively heat up. The conductive particles and/or filler may also act as an electromagnetic shield to prevent stray electromagnetic waves. Although high thermal conductivity increases the rate of heat transfer throughout the solid object, the particles need to have high enough electrical conductivity or semiconductivity so that the magnetic field generated by the inductor coils can induce an electrical eddy current and produce heat. The conductive particles and/or filler may include metallic components such as, but not limited to, copper, silver, tin, gold, aluminum, and alloys that comprise at least one of these components. Other conductive particles and/or filler include conductive carbon such as graphene and carbon nanotubes. Yet other conductive particles and/or filler may include nickel alloys of chromium, copper, manganese, aluminum, manganese-aluminum-copper alloy, or a combination thereof. The conductive particles and/or filler may also be some combination of those indicated above.

The conductive particles may have any shape and size that is capable of responding to the magnetic field generated by the inductor coils when they are energized. In some embodiments the particles may include flakes that have a thickness up to 0.005 inches, and length and width dimensions between about 0.01 inches and about one inch, depending on the particle size needed to achieve the specified spatial temperature uniformity. More specifically, the particles and/or filler may include flakes that have a thickness no more than 0.001 inches, with the largest dimension not larger than about 0.5 inches. The conductive particles and/or filler may also include filaments that have a size (length) selected to reduce the possibility of having continuous circuits form in the mixture. The filaments may have a diameter of no more than 0.01 inches and a length of no more than two inches, for example. More specifically, the filaments may have a diameter of no more than 0.005 inches and a length of no more than one inch. The conductive particles and/or filler may also be a combination of flakes, filaments or some other type of particle or filler. In some embodiments, the particles and/or filler can be selected to have specified electrical and thermal properties. For example the particles and/or filler material may be selected to have electrical conductivity and thermal conductivity within specified ranges. In some implementations, the particles include a first group of particles that have electrical conductivity within a specified range and a second group of particles that have thermal conductivity within a specified range. Similarly, the filler may include a first material that provides electrical conductivity within a specified range and a second material that provides thermal conductivity within a specified range. The combination of both electrically conductive and thermally conductive particles and/or filler materials can be employed to achieve a target temperature uniformity of the ink carrying portion, for example. In some implementations, ferric particles and/or filler provide the electromagnetically inductive response and copper particles and/or filler enhance the thermal spreading.

Figure 7:
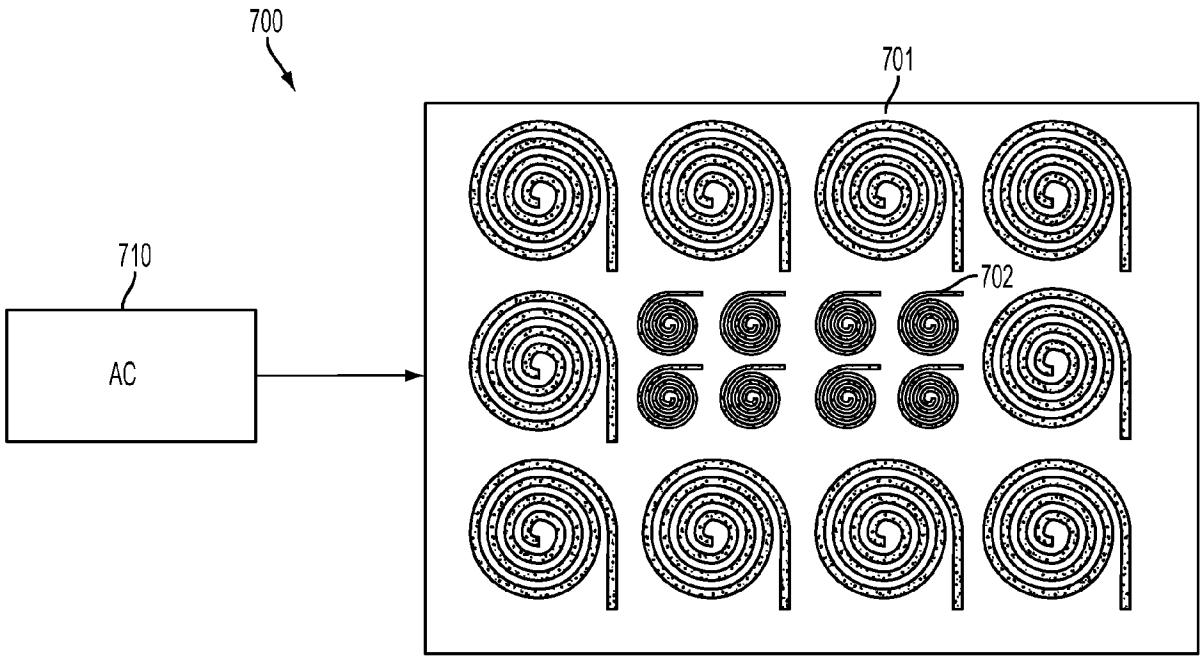
FIG. 7 is a detailed view of a coil arrangement for the inductive heating portion.

FIG. 7 illustrates a coil arrangement for the inductive heating portion in accordance with one embodiment. The inductor coils 701, 702 of a print head inductive heater may be a variety of sizes or may be all the same size. In some embodiments, the inductor coils 701, 702 are distributed within the inductive heating portion 700 to produce a uniform heating pattern in the ink-carrying portion. The use of different size coils may be employed to achieve a specified temperature uniformity across the ink carrying portion. For example, smaller coils can be used in one region and larger coils in another region to achieve a specified temperature uniformity across both of the regions. In some implementations, the print head inductive heater may be designed for a different specified temperature and/or specified temperature uniformity in each region. For example, the specified heating uniformity range is achievable using the inductive heating embodiments disclosed herein may be within about ±5° C., ±1° C., ±0.5° C., or even about ±0.25° C. for a solid ink print head. In some embodiments, the inductor coils 701, 702 are distributed within the inductive heating portion so that the induced heat at the edges of the ink-carrying portion is greater than induced heat at a center of the ink-carrying portion. More specifically, the watt density values at the edges may be three or four times than that of the center, e.g., 2-3 $W/m^2$ vs. 10 $W/m^2$.

The coils 701, 702 may be electrically connected to each other and/or the AC source 710 in any convenient configuration. For example, the coils 701, 702 may be connected in series or parallel or in any combination of series and parallel connections. The frequency provided by the AC source 710 may be at least 1 MHz, and more specifically may be between 20 MHz and 100 MHz. In some embodiments, the AC source 710 operates at a voltage of at least 10 kV, less than 1 A, and at least 1 MHz. More specifically, the AC source 710 operates at a voltage greater than 20 kV, about 0.5 A and between about 20 MHz and 100 MHz.

In some embodiments, the AC current to groups of inductor coils or to each inductor coil individually can be independently controlled. For example, in some configurations, each of the individual coils or groups of coils may be connected to a dedicated controllable AC source. In some configurations the coils or groups of coils can be independently energized using controllable switches or solenoids that electrically connect and disconnect the coils to an AC source.

Figure 8A:
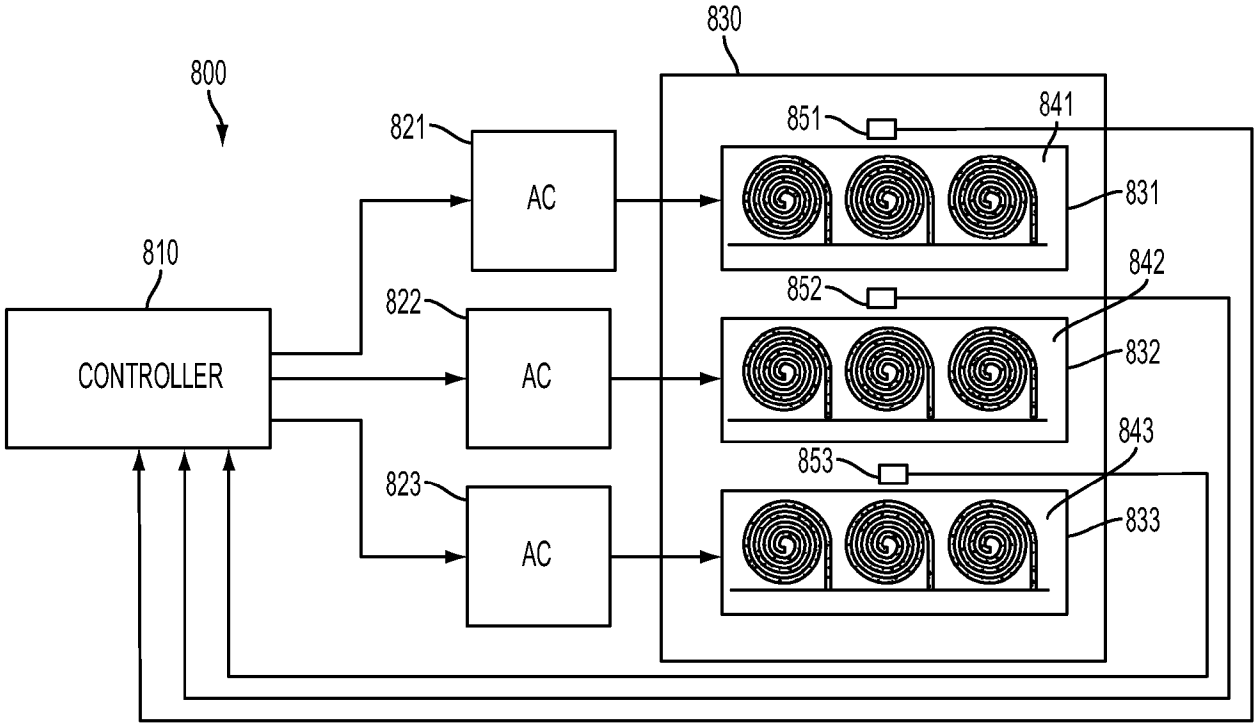
FIGS. 8A and 8B are conceptual block diagrams of assemblies that include a feedback control system.

FIG. 8A is a conceptual block diagram of an assembly 800 including a controller 810, a print head 830 with multiple regions 831, 832, 833. Each region is respectively associated with at least one group of inductive heating elements 841, 842, 843, at least one thermal sensor 851, 852, 853 and alternating current source 821, 822, 823. The assembly 800 comprises a dynamic feedback system that energizes the groups 841, 842, 843 of inductive heating elements in a way that accounts for changing thermal conditions. The controller 810 controls a plurality of alternating current sources 821, 822, 823. The controller can be configured to independently control the electrical parameters (e.g., frequency, duty cycle, voltage, current) of the output of each alternating current source 821, 822, 823 based on temperature feedback from temperature sensors 851, 852, 853. Each of the AC sources 821, 822, 823 is electrically coupled to one of a plurality of groups of inductor coils 841, 842, 843 and provides an alternating current to each inductor coil in its respective group of coils 841, 842, 843. Each group 841, 842, 843 includes one or more coils that can be arranged in the inductive heating portion of the print head 830 so as to achieve a desired heating distribution that provides a temperature uniformity within a specified tolerance range. The thermal sensors 851, 852, 853 are thermally connected to the print head 830 and generate electrical signals responsive to the sensed temperature in the regions 831, 832, 833. The electrical signals generated by the thermal sensors 851, 852, 853 provide temperature feedback signals to the controller 810. For example, a thermal sensor 851, 852, 853 may be located proximate to a corresponding group of inductor coils 841, 842, 843 and/or proximate to an ink carrying portion that is inductively heated by the group of inductor coils 841, 842, 843. The controller 810 can be configured to adjust parameters of the AC output signal of an AC source energizing each group of inductor coils 841, 842, 843 to achieve a specific heat distribution or temperature profile in an ink-carrying portion. In some embodiments, the controller is configured to selectively control the AC signal to achieve a watt density at edges of the print head that is greater than a watt density at a center of the print head to maintain a selected temperature profile.

n. In some embodiments, the desired heat distribution or temperature profile includes maintaining the temperature uniformity across the regions 831, 832, 833 to within about ±5° C., ±1° C., ±0.5° C., or even about ±0.25° C., for example.

Figure 8B:
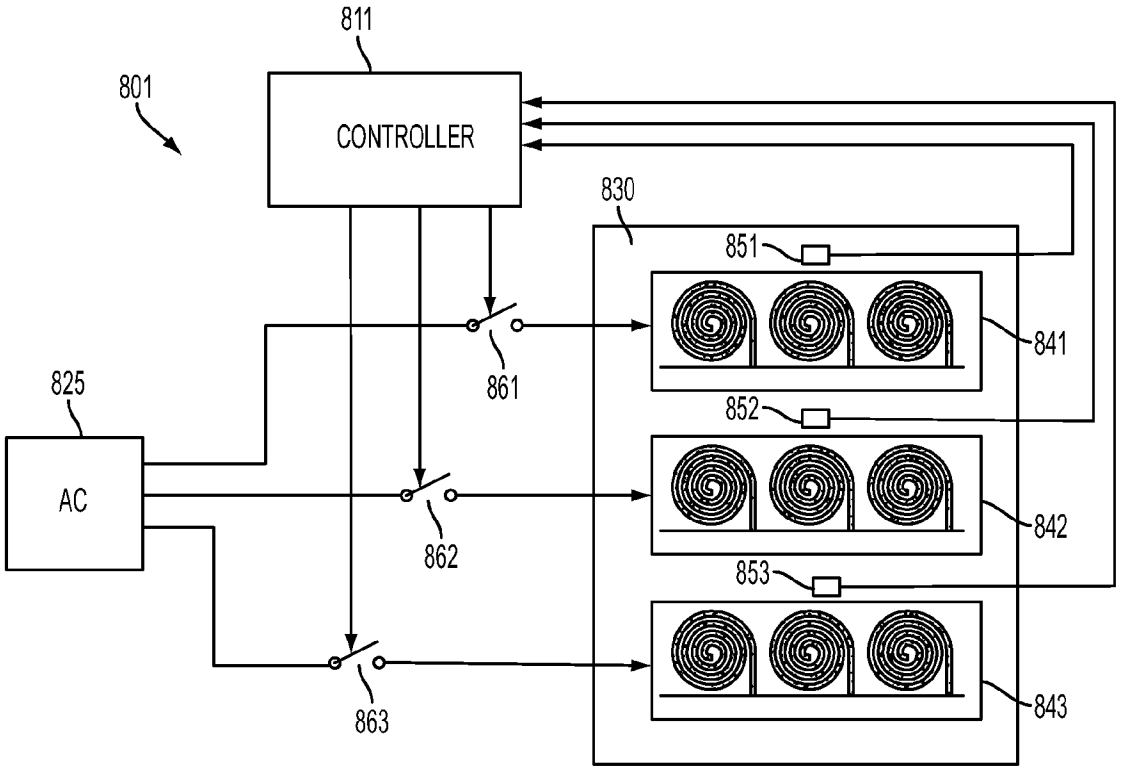

FIG. 8B illustrates another print head assembly 801 including a controller 811 for a print head inductive heater. As in the previous example, the assembly 801 includes groups of coils 841, 842, 843 arranged regions 831, 832, 833 of a print head 830. Assembly 801 includes a bank of electrically controllable switches 861, 862, 863 that can be used to selectively energize groups of the coils 841, 842, 842. One or more temperature sensors 851, 852, 853 are thermally coupled to the print head 830. The one or more temperature sensors 851, 852, 853 sense temperature at one or more locations of the print head 830 and generate electrical signals in response to the sensed temperature. In some implementations, as illustrated in FIG. 8B, there is a temperature sensor 851, 852, 853 respectively associated with a region 831, 832, 843 of the print head 830 and a group of coils 841, 842, 843.

The electrical signals from the temperature sensors 851, 852, 853 provide temperature feedback signals for the controller 811. Based on the temperature feedback signals, the controller selectively couples one or more of the groups of coils 841, 842, 843 to the AC source 825. By selecting the groups of coils 841, 842, 843 that are energized based on the temperature feedback signals, the controller can maintain the temperature uniformity across the regions 831, 832, 833 to within a specified tolerance range. For example, based on the temperature feedback signals, at a first point in time all the coil groups 841, 842, 843 may be connected through the switches 861, 862, 863 to the AC source 825; at a second point in time only one of the coil groups may be connected to the AC source 825; at a third point in time none of the coil groups is connected to the AC source 825.

Figure 9:
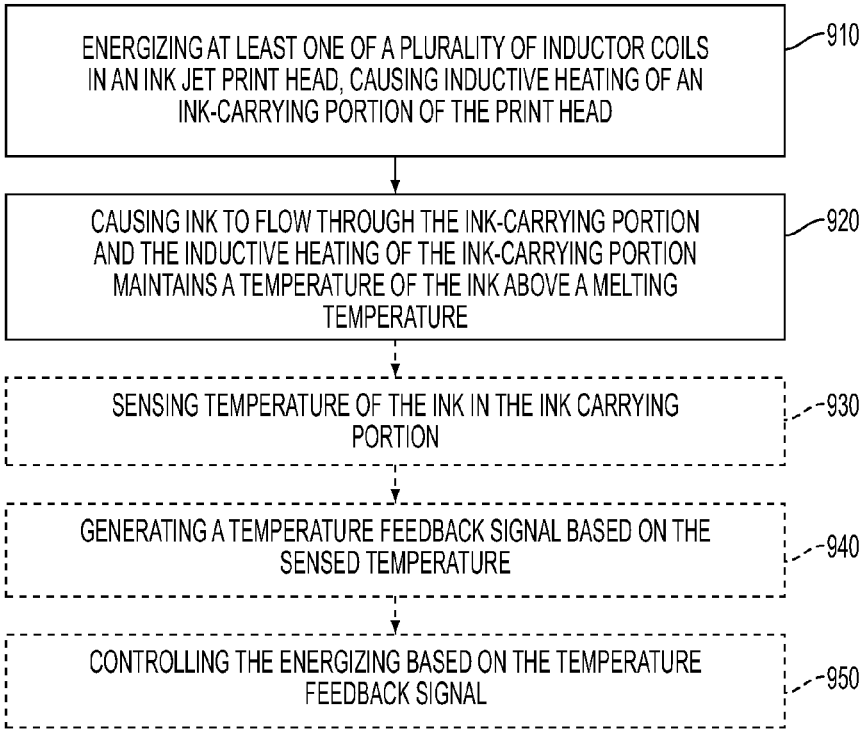
FIG. 9 is a flow diagram illustrating a method of using a print head with inductive heating features.

FIG. 9 is a flow diagram illustrating a method of inductively heating an inkjet print head. The method includes energizing 910 at least one of the plurality of inductor coils arranged in an inkjet print head. Energizing the at least one coil causes inductive heating of an ink-carrying portion of the print head. The ink is heated as the ink flows 920 through the ink-carrying portion. The heating of the ink maintains a temperature of the ink above a melting temperature due to the inductive heating. The inductive heating may provide a uniform heating distribution of the ink carrying portion to maintain a relatively uniform ink temperature for inkjet printing as the ink passes through the ink carrying portion. In some embodiments, the method may optionally include sensing 930 a temperature of the ink or a region of the print head and generating 940 a temperature feedback signal. The temperature feedback signal may be used to selectively control 950 energizing the plurality of inductor coils based on the temperature feedback signal. In some embodiments, the controller may provide alternating current to some of the plurality of inductor coils but not others or it may adjust the alternating current of each inductor coil. Adjusting the alternating current may be based on the temperature feedback signal.

Figure 10:
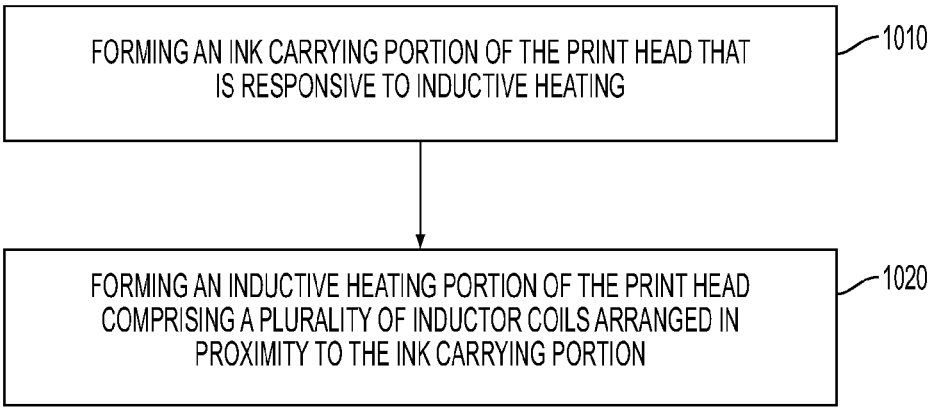
FIG. 10 is a flow diagram illustrating a method of manufacturing a print head with inductive heating features.

FIG. 10 is a flow diagram illustrating a method of manufacturing a print head with inductive heating features. The method includes forming 1010 an ink-carrying portion of a print head that is responsive to inductive heating and arranging 1020 a plurality of inductor coils in proximity to the ink-carrying portion so that the inductor coils induce heat in the ink-carrying portion when energized. Injection molding may be used to form the inkjet print heads. Injection molding of plastics using overmolding can be used to make plastic objects that include metal components. These metallic components can include conductive traces, wires or coils thereof. In some embodiments, conductive particles and/or filler are used to create an inductive heating response in the ink-carrying portion. The polymeric ink-carrying portion of the print head may be heated above the phase change temperature of the solid ink contained within, therefore the polymer used for injection molding must be stable at the operating temperature of the ink jetting process. Typical operating temperatures of solid ink jet printers can be from about 120° C. to about 150° C. and solid wax-based inks are an organic solvent that can attack or swell polymeric materials. Typical materials used to injection mold inkjet print heads include but are not limited to polystyrene, polysulfone, and polyetherketone. In some embodiments, using a low melting tin/zinc alloy in conjuction with fine copper fibers can be used to make highly electrically conductive injection moldable plastics. Additionally, the freezing of a polymer at the same time or later than the conductive particles and/or filler, such as a metal alloy, in addition to a low viscosity of material may enhance the level and homogeneity of electrical conductivity.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Particular materials and dimensions thereof recited in the disclosed examples, as well as other conditions and details, should not be construed to unduly limit this disclosure. Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

What is claimed is:

1. An assembly comprising:

a print head that includes:

an ink-carrying portion capable of inductive heating response, the ink-carrying portion comprising:

a first side and an opposing second side, and a polymer containing conductive particles;

a first inductive heating portion proximate to the first side of the ink-carrying portion, a second inductive heating portion proximate the opposing second side of the ink-carrying portion, the first and second inductive heating portions comprising a plurality of inductor coils arranged along the ink-carrying portion, each of the inductive coils, when energized, configured to generate a magnetic field that induces heat in the ink carrying portion, the plurality of inductive coils distributed in the inductive heating portion so that induced heat at edges of the ink carrying portion is greater than induced heat at a center of the ink carrying portion.

2. The assembly of claim 1, wherein the conductive particles comprise carbon nanotubes, metallic particles, nickel alloy of chromium, nickel alloy of copper, nickel alloy of manganese, nickel alloy of aluminum, or manganese-aluminum-copper alloy, or combinations thereof.

3. The assembly of claim 1, wherein the plurality of inductor coils comprise a metallic material.

4. The assembly of claim 1, wherein each inductor coil of the plurality of inductor coils comprises a flat, spiral coil.

5. The assembly of claim 1, wherein each inductor coil of the plurality of inductor coils has a diameter of less than about 1 mm.

6. The assembly of claim 1, further comprising a source of alternating current configured to be electrically connected to at least one of the plurality of inductor coils.

7. The assembly of to claim 6, wherein the alternating current signal has a frequency of at least 1 MHz.

8. The assembly of claim 6, wherein the alternating current signal has a frequency between about 20 MHz and 100 MHz, a current of about less than 1.0 A and a voltage of about at least 10 kV.

9. The assembly of claim 1, further comprising:

one or more thermal sensors thermally connected to the print head, each thermal sensor configured to sense temperature of the print head and to generate a temperature feedback signal in response to the sensed temperature;

an alternating current (AC) source coupled to provide AC to the coils;

a controller configured to control the AC provided to the coils based on the temperature feedback signals from the sensors.

10. The assembly of claim 9, wherein:

the one or more thermal sensors comprises multiple thermal sensors respectively disposed at multiple regions of the print head; and the controller is configured to selectively control the AC signal provided to coils disposed at the locations based on the sensor signals.

11. The assembly of claim 10, wherein the controller is configured to selectively control the AC signal provided to the regions to maintain a selected temperature profile in the print head.

12. The assembly of claim 11, wherein the controller is configured to selectively control the AC signal to achieve a watt density at edges of the print head that is greater than a watt density at a center of the print head to maintain the selected temperature profile.

13. A method comprising:

energizing at least one of a plurality of inductor coils arranged in an ink jet print head, the energizing causing inductive heating an ink-carrying portion of the print head, the ink carrying portion comprising:

a first side and an opposing second side, and a polymer containing conductive particles;

flowing ink through the ink-carrying portion;

inductively heating the ink-carrying portion using a first inductive heating portion proximate to the first side of the ink-carrying portion and a second inductive heating portion proximate the opposing second side of the ink-carrying portion, wherein the inductive heating of the ink-carrying portion maintains a temperature of the ink above a melting temperature of the ink and the induced heat at edges of the ink carrying portion is greater than induced heat at a center of the ink carrying portion.

14. The method of claim 13, further comprising:

sensing temperature at one of more regions of the print head; and generating a temperature feedback signal based on the sensed temperature.

15. The method of claim 13, further comprising controlling the energizing based on the temperature feedback signal.

16. The method of claim 13, wherein controlling the energizing comprises at least one of:

providing alternating current to some of the inductor coils and not to others;

adjusting electrical parameters of the alternating current signal to one or more of the inductor coils.

17. The method of claim 13, wherein energizing at least one of a plurality of inductor coils comprises energizing using an alternating current signal providing a frequency between about 20 MHz and 100 MHz, a current of about less than about 1.0 A and a voltage of at least about 10 kV to the inductor coils.

18. A method comprising:

forming an ink carrying portion of a print head that is responsive to inductive heating, the ink carrying portion comprising:

a first side and an opposing second side, and a polymer containing conductive particles;

forming a first inductive heating portion proximate to the first side of the ink-carrying portion;

forming a second conductive heating portion proximate the opposing side of the ink-carrying portion, the first and the second inductive heating portions including a plurality of inductor coils, the first and second inductive heating portions arranged in proximity to the ink carrying portion so that the inductor coils, when energized, heat the ink carrying portion, the plurality of inductive coils distributed in the inductive heating portion so that induced heat at edges of the ink carrying portion is greater than induced heat at a center of the ink carrying portion.

19. The method of claim 18, wherein forming the ink carrying portion and the inductive heating portion comprises injection molding the ink carrying portion and the inductive heating portion.

20. The method of claim 18, wherein forming the inductive heating portion comprises:

arranging conductive polymer or metallic coils in a mold; and overmolding the conductive polymer coils.

* * * * *